US010317075B2

(12) United States Patent
Wui

(10) Patent No.: US 10,317,075 B2
(45) Date of Patent: Jun. 11, 2019

(54) WASTE PLASTIC SOLID FUEL INCINERATOR

(71) Applicant: SGT CO., LTD., Suncheon, Jeollanam-do (KR)

(72) Inventor: Kay Dae Wui, Jeollanam-do (KR)

(73) Assignees: SGT CO., LTD., Suncheon, Jeollanam-do (KR); Kay Dae Wui, Suncheon, Jeollanam-do (KR); Hwan We, Suncheon, Jeollanam-do (KR)

( * ) Notice: Subject to any disclaimer, the term of this patent is extended or adjusted under 35 U.S.C. 154(b) by 423 days.

(21) Appl. No.: 15/309,651

(22) PCT Filed: Dec. 17, 2014

(86) PCT No.: PCT/KR2014/012483
§ 371 (c)(1),
(2) Date: Dec. 12, 2016

(87) PCT Pub. No.: WO2015/174604
PCT Pub. Date: Nov. 19, 2015

(65) Prior Publication Data

US 2017/0268773 A1 Sep. 21, 2017

(30) Foreign Application Priority Data

May 14, 2014 (KR) ..... 10-2014-0057890

(51) Int. Cl.
*F23G 5/16* (2006.01)
*F23G 5/44* (2006.01)
*F23G 7/12* (2006.01)

(52) U.S. Cl.
CPC ..... *F23G 5/165* (2013.01); *F23G 5/444* (2013.01); *F23G 7/12* (2013.01);
(Continued)

(58) Field of Classification Search
CPC . F23G 5/165; F23G 5/444; F23G 7/12; F23G 2202/103; F23G 2201/303
See application file for complete search history.

(56) References Cited

U.S. PATENT DOCUMENTS 3,543,700 A * 12/1970 Devita ..... F23G 5/165 110/187
3,602,161 A * 8/1971 Wyrough ..... F23G 5/165 110/179
(Continued)

FOREIGN PATENT DOCUMENTS

AT 400180 B 10/1995
FR 1025502 A 4/1953
(Continued)

OTHER PUBLICATIONS

Supplementary European Search Report dated Nov. 14, 2017 in corresponding European Patent Application No. EP 14 89 1888.1.

*Primary Examiner* — David J Laux
(74) *Attorney, Agent, or Firm* — Mintz Levin Cohn Ferris Glovsky and Popeo, P.C.; Kongsik Kim; Jhongwoo Jay Peck

(57) ABSTRACT

Provided is a plastic waste solid fuel incinerator comprising: an incinerator housing which has, on the upper portion thereof, a gas outlet through which combustion gas is discharged; a fuel supply unit which transfers and supplies a plastic waste solid fuel; a first combustion unit which continuously transfers and burns the supplied plastic waste solid fuel; a first air supply unit which supplies air needed for combustion to the first combustion unit; a combustion gas induction unit which induces the combustion gas generated from the first combustion unit toward the lower portion of a first combustion chamber; a second combustion unit which is arranged in the lower portion of the first combustion unit and comprises a downward injection nozzle
(Continued)

unit which downwardly injects the combustion gas supplied through the combustion gas induction unit in order to reburn the combustion gas; and a second air supply unit which is arranged in the lower portion of the second combustion unit and supplies the air needed for combustion to the second combustion unit by downwardly injecting the air. Accordingly, there is an advantage of allowing continuous combustion using combustion gas generated during the combustion of the plastic waste solid fuel without using a separate auxiliary fuel, thereby reducing incineration costs.

7 Claims, 5 Drawing Sheets

(52) U.S. Cl.
CPC .. *F23G 2201/303* (2013.01); *F23G 2202/103* (2013.01); *F23G 2203/8013* (2013.01)

(56) References Cited

U.S. PATENT DOCUMENTS 4,167,909 A * 9/1979 Dauvergne ..... F23B 5/04 110/207
4,321,878 A * 3/1982 Segrest ..... F23G 1/00 110/194
4,412,889 A * 11/1983 Oeck ..... C10B 47/44 202/117
4,515,089 A * 5/1985 Ehrlichmann ..... F23G 5/32 110/212
4,542,703 A * 9/1985 Przewalski ..... F23G 5/04 110/165 R
4,603,644 A * 8/1986 Brookes ..... F23G 1/00 110/165 R
5,095,826 A * 3/1992 Erisson ..... F23G 5/165 110/212
5,156,097 A * 10/1992 Booth ..... F23G 5/18 110/204
5,411,714 A * 5/1995 Wu ..... C09C 1/482 110/108
6,305,302 B2 * 10/2001 Kleiss ..... F23G 5/027 110/210
6,701,855 B2 * 3/2004 Barba ..... F23C 7/002 110/210
6,758,150 B2 * 7/2004 Ballantine ..... C10B 47/44 110/110
8,789,478 B2 * 7/2014 Kaneko ..... F23G 5/027 110/190
2002/0068846 A1 6/2002 Tsuruta
2008/0072807 A1 * 3/2008 Brookes ..... F23G 5/0273 110/346

FOREIGN PATENT DOCUMENTS

KR 20-0226144 Y1 6/2001
KR 10-2012-0110938 A 10/2012
KR 10-2011-0021283 A 9/2013
KR 10-1311849 B1 9/2013

* cited by examiner

WASTE PLASTIC SOLID FUEL INCINERATOR

CROSS-REFERENCE TO RELATED APPLICATIONS

This application is a National Phase Entry of PCT International Application No. PCT/KR2014/012483, which was filed on Dec. 17, 2014, which claims priority to Korean Application No. 10-2014-0057890 filed on May 14, 2014. The applications are incorporated herein by reference.

TECHNICAL FIELD

The present invention relates to a waste plastic solid fuel incinerator. More particularly, it relates to a waste plastic solid fuel incinerator that can, without having to use an additional energy source, completely or nearly completely incinerate a waste plastic solid fuel by using combustion gas generated during incineration of the waste plastic solid fuel.

BACKGROUND ART

Petroleum energy source is being depleted. A refuse plastic fuel (RPF) was proposed as an alternative energy source that can replace the petroleum energy source. According the guideline number 2003-127 issued by the Korean Mistry of Environment, RPF is a solid fuel that is produced by the steps of selecting, shredding, dehydrating, and forming a flammable waste plastic and contains a waste plastic in the amount of 60% or more of the solid fuel. The calorific value of waste plastic solid fuel (or PRF) is about 6,000~8,700 kcal/kg), which is similar to that of bituminous coal. The waste plastic solid fuel is cheap as it is produced from a waste plastic. It provides economic benefit by recycling a waste plastic. Combustion gas generated when a waste plastic is incinerated in an incinerator does not cause corrosion of parts of the incinerator. No special facility is required to be provided at a storage tank of a waste plastic. In addition, waste plastic solid fuel is used as an alternative energy source in many places.

Various structures of waste plastic solid fuel incinerators have been proposed, for example, as disclosed in Korean Patent No. 10-814447 ("Industrial Boiler Using Refused Plastic Fuel") and Korean Patent No. 10-1342392 ("Structure for Combustion of Solid Fuel and Incinerator Having Same Structure").

DETAILED DESCRIPTION

Problems to be Solved

An industrial boiler using refused plastic solid fuel, as proposed in Korean Patent No. 10-814447, enhances combustion rate by introducing a predetermined amount of solid fuel into a combustion chamber of the boiler and gradually moving the introduced solid fuel by a rotation roller inside the chamber. Air necessary for combustion is supplied from a surface of the rotation roller. However, an additional energy source is required, which increases overall operation costs.

An incinerator, as proposed in Korean Patent No. 10-1342392, has a structure that can prevent cohesion and adhesion of solid fuel and can reduce amount of ash. However, as upward combustion is used in the incinerator, the incineration of combustion gas is incomplete and a significant amount of smoke is generated.

One of the objectives of the present invention is to provide a waste plastic solid fuel incinerator that does not require an additional energy source and/or can perform complete incineration of combustion gas.

Another objective of the present invention is to provide a waste plastic solid fuel incinerator that recycles and re-burns combustion gas generated from incineration of a waste plastic solid fuel, thereby significantly reducing hazardous by-products (e.g., dioxin) that are normally generated during process of incinerating a waste plastic sold fuel.

Still another objective of the present invention is to provide a waste plastic solid fuel incinerator that reuses heat generated during process of incinerating a waste plastic sold fuel, thereby maximizing thermal energy efficiency.

Means to Solve the Problems

One aspect of the present invention provides a waste plastic solid fuel incinerator. The incinerator comprises an incinerator housing, a fuel supply unit, a first combustion unit, a second combustion unit, a first air supply unit, a second air supply unit, and a combustion gas induction unit.

The incinerator housing is provided, on an upper portion thereof, with a gas outlet for discharging combustion gas. The fuel supply unit is configured to supply a waste plastic solid fuel. The first combustion unit is configured to continuously transfer and incinerate the waste plastic solid fuel supplied by the fuel supply unit. The first air supply unit is configured to supply air to the first combustion unit. The combustion gas induction unit is configured to downwardly transfer combustion gas generated from the first combustion unit. The second combustion unit is arranged below the first combustion unit and comprises a downward injection nozzle unit for downwardly injecting combustion gas supplied by the combustion gas induction unit so that the combustion gas is re-burnt in the second combustion unit. The second air supply unit is arranged below the second combustion unit and is configured to upwardly inject air to the second combustion unit.

Another aspect of the present invention is to provide a waste plastic solid fuel incinerator comprising an incinerating part, a heat exchanging part, and a thermal medium jacket. The incinerating part comprises: an incinerator housing which is provided, on an upper portion thereof, with a gas outlet for discharging combustion gas; a fuel supply unit for supplying a waste plastic solid fuel; a first combustion unit for continuously transferring and burning the plastic waste solid fuel supplied by the fuel supply unit; a first air supply unit for supplying air to the first combustion unit; a combustion gas induction unit for downwardly transferring combustion gas generated from the first combustion unit; a second combustion unit which is arranged below the first combustion unit and comprises a downward injection nozzle unit for downwardly injecting the combustion gas supplied by the combustion gas induction unit so that the combustion gas is re-burnt in the second combustion unit; and a second air supply unit which is arranged below the second combustion unit and is configured to upwardly inject air to the second combustion unit.

The heat exchanging part comprises a heat exchanger housing, a plurality of heat exchanging tubes, an upper dividing wall, and a header. The heat exchanger housing is provided with a liquid inlet on a lower portion thereof and a liquid outlet on an upper portion thereof. The heat exchanger housing includes an upper gas circulation chamber defined by an upper space of the heat exchanger housing and a lower gas circulation chamber defined by a lower space of the heat exchanger housing. The plurality of heat exchanging tubes, surrounding a central gas passage provided in the heat exchanger housing, extend between the upper gas circulation chamber and the lower gas circulation chamber. The upper dividing wall divides the inner space of the upper gas circulation chamber. The header is provided with a gas outlet on an upper portion thereof.

The thermal medium jacket surrounds a side portion and an upper portion of the incinerator housing. A thermal medium is introduced from a lower portion of the thermal medium jacket and is discharged through an upper portion of the thermal medium jacket towards the liquid inlet.

In some embodiments, the first combustion unit may include a plurality of first combustion chambers arranged in a vertical direction. The first air supply unit may include a plurality of first air supply tubes for supplying air to the respective first combustion chambers.

In some embodiments, the combustion gas induction unit may comprise a gas recovery tube and a gas fan. An end of the gas recovery tube may be connected to an end of the lowest first chamber. The other end of the gas recovery tube may be connected to the downward injection nozzle unit. The gas fan may be arranged between the end of the gas recovery tube and the other end of the gas recovery tube. The gas fan may be configured to supply the combustion gas generated in the first combustion unit towards the downward injection nozzle unit.

In some embodiments, the first combustion chambers may comprise screw conveyors that are configured to continuously transfer the fuel and pulleys that are arranged at ends of the screw conveyors. The pulleys of the first combustion chambers may be connected via power transmission belts so as to transmit power to the screw conveyors of the first combustion chambers.

In some embodiments, the fuel supply unit may comprise a refuse plastic fuel (RPF) inlet hopper and an RPF inlet screw conveyor. The RPF inlet hopper may be arranged outside the incinerator housing. The RPF inlet hopper may be configured to contain a waste plastic solid fuel. The RPF inlet screw conveyor may be configured to transfer the waste plastic solid fuel contained in the RPF inlet hopper towards the first combustion unit.

In some embodiments, the waste plastic solid fuel incinerators may further comprise an air fan for supplying external air to the first air supply unit and the second air supply unit. The waste plastic solid fuel incinerators may further comprise an ash storage tank for storing ash discharged from the lowest first combustion chamber.

Advantageous Effects

According to the invention, combustion gas generated during process of incinerating a waste plastic solid fuel is recycled and reused to incinerate the waste plastic solid fuel. Thus, a waste plastic solid fuel can be incinerated in a very cost-effective way.

Also according to the invention, hazardous by-products (e.g., dioxin), which are normally generated during process of incinerating a waste plastic sold fuel, can be significantly prevented from being generated.

In addition, according to the invention, heat generated during process of incinerating a waste plastic sold fuel can be reused, thermal energy (exchange) efficiency can be maximized, various facilities and water can be heated efficiently, energy can be generated more cost effectively, and alternative energy sources can be created.

DETAILED DESCRIPTION

Hereinafter, embodiments of the present invention will be described in detail with reference to the drawings. It is to be understood, however, that the embodiments are presented for illustrative purpose only and are not constructed to limit the scope of the present invention.

Figure 1:
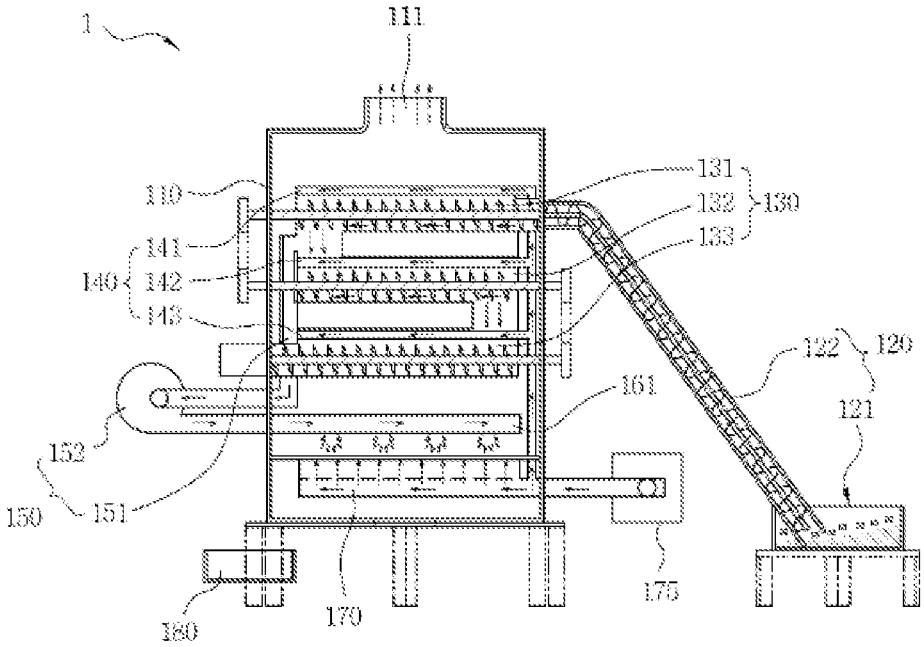
FIG. 1 is a cross-sectional view of a waste plastic solid fuel incinerator according to an embodiment of the present invention.
Figure 2:
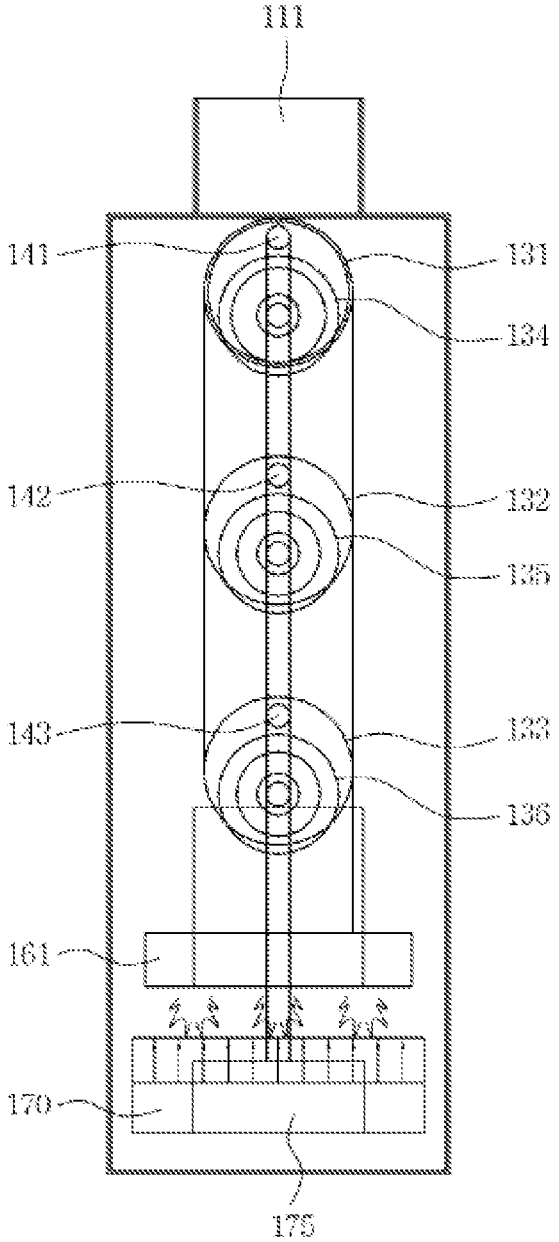
FIG. 2 is a side view of the waste plastic solid fuel incinerator of FIG. 1.

The structure of a waste plastic solid fuel incinerator (1) according to an embodiment is described in detail with reference to FIGS. 1 and 2. FIG. 1 is a cross-sectional view of the waste plastic solid fuel incinerator (1) and FIG. 2 is a side view thereof.

With reference to FIG. 1, the waste plastic solid fuel incinerator (1) comprises an incinerator housing (110), a fuel supply unit (120), a first combustion unit (130), a first air supply unit (140), a combustion gas induction unit (150), a second combustion unit (160), a second air supply unit (170), an air fan (175), and an ash storage tank (180).

The incinerator housing (110) defines a space where a waste plastic solid fuel (or refuse plastic fuel; RPF) is incinerated. The incinerator housing (10) is formed as a cylindrical shape that is closed so that ambient air outside the incinerator housing (10) is not in contact with the space. The incinerator housing (110) is provided, on an upper portion thereof, with a gas outlet (111) for discharging gas generated during incineration of the waste plastic solid fuel.

The fuel supply unit (120) for supplying the waste plastic solid fuel comprises an RPF inlet hopper (121) which is arranged at an outer side of the incinerating housing (10). The fuel supply unit (120) further comprises an RPF inlet screw conveyor (122) which transfers the supplied waste plastic solid fuel into the first combustion unit.

The RPF inlet hopper (121) defines a space where the waste plastic solid fuel is contained. An end of the RPF inlet screw conveyor (122) is placed at the RPF inlet hopper (121). The RPF inlet screw conveyor (122) is arranged with a predetermined angle with regard to the outer wall of the incinerator housing (110) so that the waste plastic solid fuel stored in the space of the RPF inlet hopper can be transferred into the incinerator housing (110). The other end of the RPF inlet screw conveyor (122) is placed inside the incinerator housing (110). Preferably, the interface between the RPF inlet screw conveyor (122) and the wall of the incinerator housing (110) may be sealed (by a rubber, for example). The RPF inlet screw conveyor (122) can be controlled by a controller (190) to move or stop. Also, the speed of the movement can be controlled by the controller (190).

The first combustion unit (130) is placed inside the incinerator housing (110). The first combustion unit (130)

continuously transfers and burns the waste plastic solid fuel supplied by the fuel supply unit. The first combustion unit (130) comprises a plurality of first combustion chambers arranged in a vertical direction.

As shown in FIGS. 1 and 2, the waste plastic solid fuel incinerator (1) may include an upper first combustion chamber (131), a middle first combustion chamber (132), and a lower first combustion chamber (133). The other end of the RPF inlet screw conveyor (122) is placed to be in communication with an upper portion of the upper first combustion chamber (131).

The upper first combustion chamber (131), the middle first combustion chamber (132), and the lower first combustion chamber (133) are provided with screw conveyors in the upper, middle, and lower first combustion chambers (131, 132, 133). For example, the upper first combustion chamber (131) is provided with an upper screw conveyor (134) in a lower portion of the upper first combustion chamber (131). The middle first combustion chamber (132) is provided with a middle screw conveyor (135) in a lower portion of the middle first combustion chamber (132). The lower first combustion chamber (133) is provided with a lower screw conveyor (136) in a lower portion of the lower first combustion chamber (133). The lower screw conveyor (136) provided in a lower portion of the lower first combustion chamber (i.e., the lowest chamber in this configuration) is used to discharge ash generated in the first combustion unit and recover. The lower screw conveyor (136) can be called as an ash recovery screw conveyor.

With reference to FIGS. 1 and 2, pulleys, sprockets, and gears may be engaged with belts, chains, and connecting gears to transmit power to the screw conveyors of the first combustion chambers.

For example, according to the embodiment described in FIGS. 1 and 2, the upper screw conveyor (134) is connected to the RPF inlet screw conveyor (122) so that they can rotate together. A pulley provided at an end of the upper screw conveyor (134) is engaged, via a power transmission belt, with another pulley provided at an end of the middle screw conveyor (135). A pulley provided at the other end of the middle screw conveyor (135) is engaged, via a power transmission belt, with another pulley provided at an end of the lower screw conveyor (136). As a result, power can be supplied to the upper screw conveyor (134), the idle screw conveyor (135), and the lower screw conveyor (136) so that they can rotate together.

The diameters of the pulleys can be designed to be same or different. They can be adjusted according to design specifics to enable fuel combustion to be uniform and fuel supply to be efficient.

The first combustion unit (130) is connected to the first air supply unit (140) which supplies to the first combustion unit air needed for combustion of the fuel supplied to the first combustion unit (130). The first air supply unit (140) includes a plurality of first air supply tubes that supply air to the plurality of first combustion chambers, respectively. For example, according to the embodiment described in FIGS. 1 and 2, the upper first combustion chamber (131), the middle first combustion chamber (132), and the lower first combustion chamber (133) are connected to an upper first air supply tube (141), a middle first air supply tube (142), and a lower first air supply tube (143), respectively. The upper first air supply tube (141) is positioned in an upper portion of the upper first combustion chamber (131), the middle first air supply tube (142) is positioned in an upper portion of the middle first combustion chamber (132), and the lower first air supply tube (143) is positioned in an upper portion of the lower first combustion chamber (133) so that the air supply tubes (141, 142, 143) can supply air downwardly.

In case of burning materials having a relatively low thermal decomposition rate, upward combustion is better than downward combustion, generally. However, if upward combustion is used to burn materials having a relatively high thermal decomposition rate, a significant amount of hazardous gas and smoke can be generated due to incomplete combustion and re-combustion (re-burn) is thus required to reduce or eliminate the hazardous decomposed gas and smoke. Accordingly, in case of combustion of materials having a relatively high thermal decomposition rate, downward combustion is better than upward combustion. The burning rate of downward combustion is approximately half the burning rate of upward combustion.

FIGS. 1 and 2 illustrate downward combustion. The present invention, however, is not limited to downward combustion. For example, as described below, if re-combustion of gas and smoke generated from the first combustion unit (130) can occur in the second combustion unit (160), upward combustion or lateral combustion can also be used.

Each of the first combustion chambers (131, 132, 133) may be formed as a duct. For example, the first combustion chambers may be formed as a duct having a rectangular or any other polygonal cross-section. Although the first combustion chambers horizontally extend in FIGS. 1 and 2, they can be positioned to extend downwardly with a predetermined angle. An example of the predetermined angle is about 2 to about 7 degrees.

Fuel and combustion gas inside a combustion chamber move toward an end of the combustion chamber. The fuel and combustion gas can move to a next combustion chamber located below the combustion chamber.

For example, according to the embodiment described in FIGS. 1 and 2, a waste plastic solid fuel is supplied from the RPF inlet screw conveyor (122) to an end of the upper first combustion chamber (131). The waste plastic solid fuel supplied to the upper first combustion chamber (131), while being burnt, moves toward the other end of the upper first combustion chamber (131). At the other end of the upper first combustion chamber (131), waster plastic solid fuel that is not completely burnt in the upper first combustion chamber (131) and combustion gas generated in the upper first combustion chamber (131) are supplied to an end of the middle first combustion chamber (132) located below the upper first combustion chamber (131). The waste plastic sold fuel supplied to the middle first combustion chamber (132), while being burnt, moves to the other end of the middle first combustion chamber (132). At the other end of the middle first combustion chamber (132), waster plastic solid fuel that is not completely burnt in the middle first combustion chamber (132) and combustion gas generated in the middle first combustion chamber (132) are supplied to an end of the lower first combustion chamber (133) located below the middle first combustion chamber (132). The waste plastic solid fuel supplied to the lower first combustion chamber (133) moves toward the other end of the lower first combustion chamber (132). While moving toward the other end of the lower first combustion chamber (131), the waste plastic solid fuel is burnt to be ash. The ash is discharged. On the other hand, combustion gas generated in the lower first combustion chamber (133) moves toward the second combustion unit (160) via the combustion gas induction unit (150).

Although the first combustion unit (130) of the waste plastic solid fuel incinerator according to the embodiment described in FIGS. 1 and 2 has three combustion chambers, the present invention is not limited thereto. The number of the combustion chambers of the first combustion unit as well as the size of the incinerator, the speed of introduction of a waste plastic solid fuel, and so on can be chosen appropriately in accordance with design needs and desired function.

When the incinerator (1) is initially operated, a burner (not shown) provided inside the upper first combustion chamber (131) is used to heat the waste plastic solid fuel that is supplied to the upper first combustion chamber (131) from the RPF inlet screw conveyor (122). Once the combustion gas that is generated in the lower first combustion chamber (133) and is supplied to the second combustion unit (160) is re-burnt in the second combustion unit (160), thermal energy generated from the second combustion unit (160) can be transferred to the first combustion unit (130) and can be used to burn the waste plastic solid fuel in the first combustion unit (130). In this case, the burner may keep being operated or may be turned off.

The combustion gas induction unit (150) comprises a gas recovery tube (151). An end of the gas recovery tube (151) is connected to an end of the lower first chamber (133) and the other end of the gas recovery tube (151) is connected to a downward injection nozzle unit (161). The combustion gas induction unit (150) further comprises a gas fan (152) that is arranged between the end and the other end of the gas recovery tube (151) and supplies the combustion gas generated in the first combustion unit (130) towards the downward injection nozzle unit (161).

The combustion gas induction unit (150) introduces the combustion gas generated in the first combustion unit (130) into the second combustion unit (160). According to the embodiment described in FIGS. 1 and 2, the gas recovery tube (151) is formed as a circular tube. An end of the circular tube is connected to the lower first combustion chamber (133) and the other end of the circular tube is connected to the downward injection nozzle unit (161).

The second combustion unit (160) comprises the downward injection nozzle unit (161) for downwardly injecting the combustion gas supplied by the combustion gas induction unit (150) into the second combustion unit (160). The downward injection nozzle (161) is positioned below the first combustion unit (130). A gas fan (152) is arranged between the end and the other end of the gas recovery tube (151) and functions to force the combustion gas generated in the first combustion unit (30) to be supplied towards the downward injection nozzle unit (161).

The second air supply unit (170) is arranged below the downward injection nozzle unit (161). The second air supply unit (170) upwardly injects air to the second combustion unit (160). With the air, the combustion gas that is supplied from the first combustion unit (130) to the second combustion unit (160) by the combustion gas induction unit (150) can be re-burnt in the second combustion unit (160).

The temperature of the combustion gas injected by the downward injection nozzle unit (161) is higher than the temperature of the air injected by the second air supply unit (170). The combustion gas and the air are injected by the downward injection nozzle unit (161) and the second air supply unit (170), respectively, to a space between the downward injection nozzle unit (161) and the second air supply unit (170), in which space the combustion gas supplied by the combustion gas induction unit (150) is re-burnt.

By forcing the combustion gas generated in the first combustion unit (130) to be transferred to the second combustion unit (160) and re-burning the combustion gas in the second combustion unit (160), the incinerator according to the embodiment of the present invention can completely burn hazardous materials such as dioxin. Also, the maximum thermal energy can be recovered and the maximum thermal power can be achieved.

When the combustion gas is re-burnt in the second combustion unit (160), heat and combustion gas are generated in the second combustion unit (160). The heat and combustion gas move upwardly so as to supply thermal energy to the first combustion unit (130). The thermal energy supplied to the first combustion unit (130) can contribute to maintain the temperature of the first combustion unit (130) that is necessary to burn the waste plastic solid fuel introduced into the first combustion unit (130).

The air fan (175) is provided outside the incinerator housing (110) and supplies ambient (external) air to the first air supply unit (140) and the second air supply unit (170). The air fan (175) may be operated by an air fan motor. The operation of the air fan (175) and the air fan motor may be controlled by the controller (190). For example, the overall amount of air introduced to the incinerator may be controlled by the controller (190). Also, the amount of air introduced to the first air supply unit (140) and the amount of air introduced to the second air supply unit (170) may be controlled by the controller (190).

The incinerator according to the embodiment described in FIGS. 1 and 2 have one air fan (175) to supply air to the first air supply unit (140) and the second air supply unit (170), but the present invention is not limited thereto. For example, an air fan may be provided to supply air to the first air supply unit (140), a separate air fan may be provided to supply air to the second air supply unit (170), and the two air fans may be controlled by the controller (190).

As described above, the combustion gas generated in the first combustion unit (130) is forcedly circulated by the combustion gas induction unit (150) to the second combustion unit (160) and complete combustion of the combustion gas can be achieved when the forcedly circulated combustion gas is re-burnt in the second combustion unit (160). Heat generated when the combustion gas is re-burnt in the second combustion unit (160) is transferred to the first combustion unit (130) and the transferred heat is used to burn the waste plastic solid fuel introduced into the first combustion unit (130). Accordingly there is no need to use additional energy source to run the incinerator. Heat that is discharged through a gas outlet (111) provided in the upper portion of the incinerator housing (110) as well as the combustion gas that is completely burnt in the second combustion unit (160) may be supplied to a heat exchanging part (20), thereby increasing efficiency of energy management.

The ash storage tank (180) is provided below the lower first combustion chamber (133). The ash is transferred, while being mixed, by the ash recovery screw conveyor (136) from the lower first combustion chamber (133) to the ash storage tank (180).

The controller (190), as described above, controls the operation of the RPF inlet screw conveyor (122) and the ask recovery screw conveyor (136). For example, the amount of the waste plastic solid fuel that is introduced into the first combustion unit (130) and the amount of the ash that is discharged from the first combustion unit (130) may be controlled. In addition, the controller (190) controls the operation of the air fan (175), the first air supply unit (140), and the second air supply unit (170). For example, the amount and flow rate of air that is supplied to the first air supply unit (140) and the amount and flow rate of air that is supplied to the second air supply unit (170) may be controlled.

Hereinafter, a waste plastic solid fuel incinerator (2) according to another embodiment of the present invention is described with reference to FIGS. 3 to 5. The incinerator (2) includes an incinerating part (10) and a heat exchanging part (20).

The incinerating part (10) is identical to the incinerator (1) described above with reference to FIGS. 1 and 2. Detailed explanation thereof is thus omitted.

Figure 3:
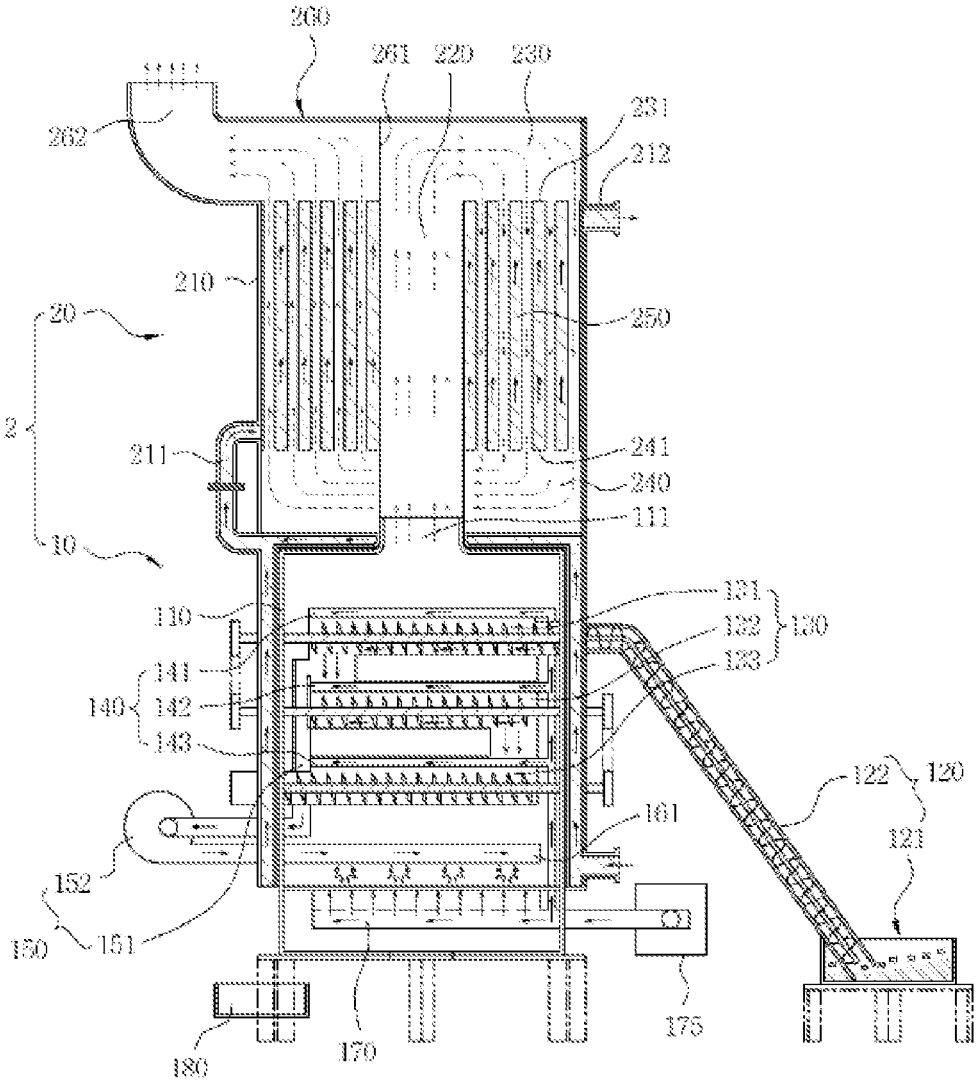
FIG. 3 is a cross-sectional view of a waste plastic solid fuel incinerator according to another embodiment of the present invention.
Figure 4:
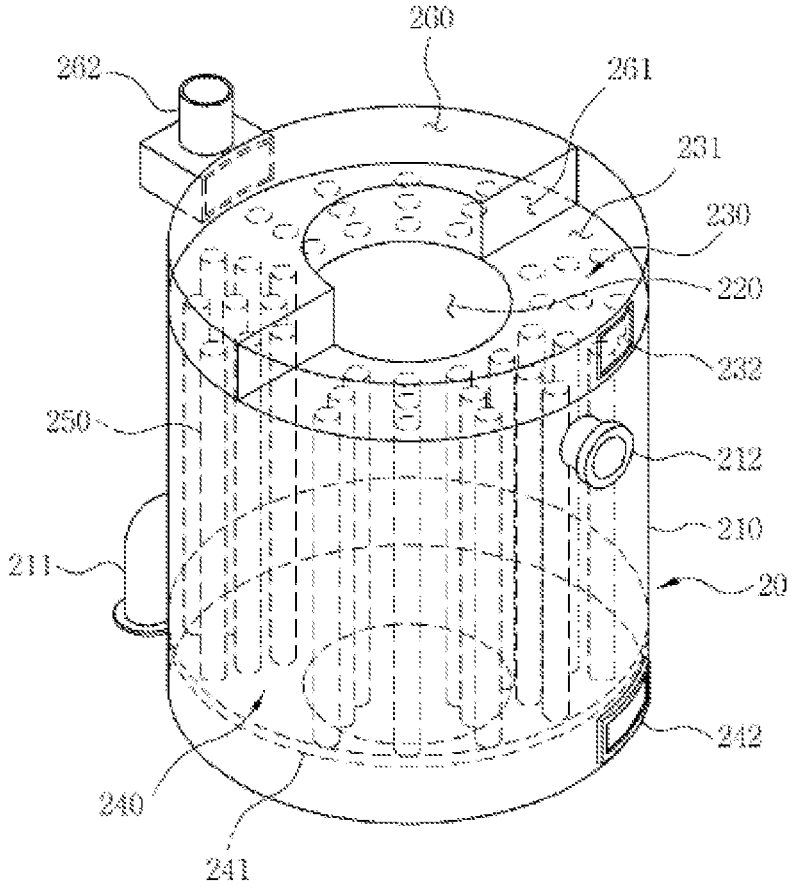
FIG. 4 is a prospective view of the waste plastic solid fuel incinerator of FIG. 3.
Figure 5:
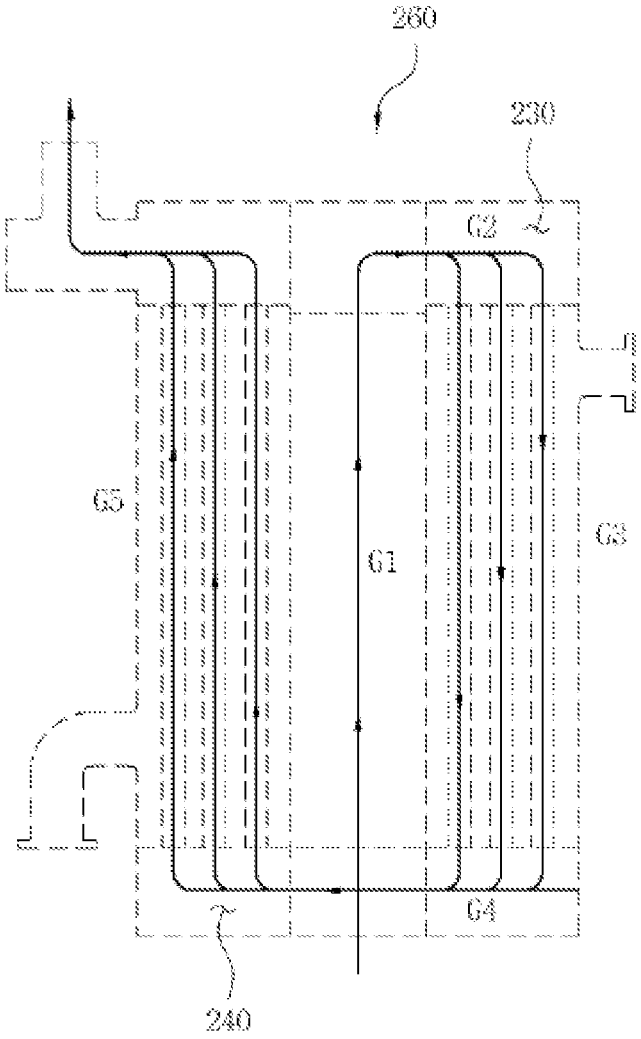
FIG. 5 depicts the flow of combustion gas in the waste plastic solid fuel incinerator of FIG. 3.

FIG. 3 is a cross-sectional view of a waste plastic solid fuel incinerator according to another embodiment of the present invention, FIG. 4 is a prospective view of the incinerator, and FIG. 5 depicts the flow of combustion gas in the incinerator.

The heat exchanging part (20) includes a heat exchanger housing (210), a central gas passage (220), an upper gas circulation chamber (230), a lower gas circulation chamber (240), a plurality of heat exchanging tubes (250), and a header (260).

The heat exchanging part (20) is connected to the upper portion of the incinerating part (10). The heat exchanging part (20) transfers the heat discharged from the incinerating part (10) to a liquid thermal medium such as water and oil.

With reference to FIGS. 3 and 4, the heat exchanger housing (210) is provided with a liquid inlet (211) on a lower portion thereof and a liquid outlet (212) on an upper portion thereof. A liquid thermal medium is introduced, via the liquid inlet (211), into the heat exchanger housing (210). Inside the heat exchanger housing (210), the introduced liquid thermal medium exchanges heat with the combustion gas flowing inside the plurality of heat exchanging tubes (250). The liquid thermal medium heated by the combustion gas is discharged through the liquid outlet (212). If desired, a pump (now shown) can be installed to facilitate the liquid thermal medium to be discharged.

The central gas passage (220) extends vertically from the gas outlet (111) so that the combustion gas discharged from the gas outlet (111) moves upwardly. The thermal medium and the combustion gas flow inside the heat exchanger housing while they are not mixed with each other.

An upper dividing wall (231) is provided inside the upper gas circulation chamber (230). The upper dividing wall (231) divides the upper, inner space of the heat exchanger housing (210) into an upper space and a lower space. The combustion gas flowing through the central gas passage is collected in the upper space.

A lower dividing wall (241) is provided inside the lower gas circulation chamber (240). The lower dividing wall (241) divides the lower, inner space of the heat exchanger housing (210) into an upper space and a lower space.

The heat exchanging tubes (250) extend vertically inside the heat exchanger housing (210) so as to surround the central gas passage (220). The upper ends of the heat exchanging tubes (250) are in fluid communication with the upper gas circulation chamber (230) and the lower ends thereof are in fluid communication with the lower gas circulation chamber (240). The combustion gas flows inside the heat exchanging tubes (250).

The header (260) is provided with a boundary wall (261) that divides the inner space of the upper gas circulation chamber (230) into a left chamber and a right chamber. The header (260) is also provided with a gas outlet (262) on an upper portion thereof. The combustion gas collected in the upper gas circulation chamber (230) flows, through a set of the heat exchanging tubes (250) that are in fluid communication with the right chamber, downwardly towards the lower gas circulation chamber (240). The combustion gas that is introduced into the lower gas circulation chamber (240) flows, through the other set of the heat exchanging tubes (250) that are in fluid communication with the left chamber, upwardly towards the upper gas circulation chamber (240). The combustion gas that is introduced into the upper gas circulation chamber (240) is discharged through the gas outlet (262).

The heat exchanging part (20) is disposed on the incinerating part (10) such that the central gas passage (220) of the heat exchanging part (20) is air tightly connected to the gas outlet (111) of the incinerating part (10).

The incinerator (2) may further comprise a thermal medium jacket which surrounds a side portion and an upper portion of the incinerator housing (110). For example, the heat discharged through the side portion can be used to preheat the liquid thermal medium that is to be introduced into the heat exchanging part (20), which minimizes energy loss and maximizes energy efficiency. The liquid thermal medium is introduced from a lower portion of the thermal medium jacket and discharged through an upper portion of the thermal medium jacket. The discharged liquid thermal medium is supplied, via the liquid inlet (211), to the heat exchanging part (20).

With reference to FIG. 5, the flow of combustion gas in the heat exchanging part is described. The combustion gas introduced into the heat exchanging part (20) flows through the central gas passage towards the upper gas circulation chamber (230), as represented by the arrow G1. The combustion gas collected in the upper gas circulation chamber (230) flows towards the right chamber of the upper gas circulation chamber (230), as represented by the arrow G2. The combustion gas then flows, through a set of the heat exchanging tubes (250) that are in fluid communication with the right chamber, downwardly towards the lower gas circulation chamber (240), as represented by the arrow G3. The combustion gas that is introduced into the lower gas circulation chamber (240) flows in the left direction, as represented by the arrow G4. The combustion gas then flows, through the other set of the heat exchanging tubes (250) that are in fluid communication with the left chamber of the upper gas circulation chamber (230), upwardly towards the upper gas circulation chamber (240), as represented by the arrow G5. The combustion gas that is introduced into the upper gas circulation chamber (240) is discharged through the gas outlet (262).

According to the embodiment of the present invention, the liquid thermal medium is circulated inside the heat exchanger housing (210) so that the time during which the liquid thermal medium is in contact with the combustion gas is quite long, thereby enabling the heat exchange between the thermal medium and the combustion gas to be significantly efficient. In addition, the incinerating part (10) and the heat exchanging part (20) may be configured to be separable from each other. Also, windows (232, 242) that can be open and closed may be provided to monitor the flow of the combustion gas.

According to the embodiments of the invention, waste plastic solid fuel can be incinerated cost effectively by incinerating the waste plastic sold fuel continuously by using combustion gas generated during the process of combustion of the waste plastic solid fuel, without having to use additional energy source.

Also according to the embodiments of the invention the invention, hazardous by-products (e.g., dioxin), which are normally generated during the process of incinerating waste plastic sold fuel, can be significantly prevented from being generated by recycling combustion gas.

In addition, according to the embodiments of the invention, heat generated during the process of incinerating waste plastic sold fuel can be reused and the thermal exchange efficiency of thermal medium can be maximized, thereby efficiently heating various facilities and water.

The present invention has been illustrated by the above embodiments, but it should be understood that the above embodiments are only for purposes of illustration and description, and are not intended to limit the invention within the scope of the embodiments described. Also skilled in the art will be appreciated that the present invention is not limited to the embodiments described above, in accordance with the teachings of the present invention can also make variations and modifications more of these variations and modifications are within the present invention as claimed.

The invention claimed is:

1. A waste plastic solid fuel incinerator comprising:

an incinerator housing which is provided, on an upper portion thereof, with a gas outlet for discharging combustion exhaust;

a fuel supply unit for supplying a waste plastic solid fuel;

a first combustion unit for continuously transferring and incinerating the waste plastic solid fuel supplied by the fuel supply unit to generate combustion gas that is combustible;

a first air supply unit for supplying air to the first combustion unit;

a combustion gas induction unit for downwardly transferring the combustion gas generated from the first combustion unit;

a second combustion unit which is arranged below the first combustion unit and comprises a downward injection nozzle unit for downwardly injecting the combustion gas supplied by the combustion gas induction unit so that the combustion gas is re-burnt in the second combustion unit; and a second air supply unit which is arranged below the second combustion unit and is configured to upwardly inject air to the second combustion unit.

2. A waste plastic solid fuel incinerator comprising:

(i) an incinerating part that comprises:

an incinerator housing which is provided, on an upper portion thereof, with a gas outlet for discharging combustion exhaust;

a fuel supply unit for supplying a waste plastic solid fuel;

a first combustion unit for continuously transferring and burning the plastic waste solid fuel supplied by the fuel supply unit to generate combustion gas that is combustible;

a first air supply unit for supplying air to the first combustion unit;

a combustion gas induction unit for downwardly transferring to combustion gas generated from the first combustion unit;

a second combustion unit which is arranged below the first combustion unit and comprises a downward injection nozzle unit for downwardly injecting the combustion gas supplied by the combustion gas induction unit so that the combustion gas is re-burnt in the second combustion unit; and a second air supply unit which is arranged below the second combustion unit and is configured to upwardly inject air to the second combustion unit;

(ii) a heat exchanging part that comprises:

a heat exchanger housing which is provided with a liquid inlet on a lower portion thereof and a liquid outlet on an upper portion thereof and which includes an upper gas circulation chamber defined by an upper space of the heat exchanger housing and a lower gas circulation chamber defined by a lower space of the heat exchanger housing;

a plurality of heat exchanging tubes which extend between the upper gas circulation chamber and the lower gas circulation chamber and surround a central gas passage;

an upper dividing wall that divides the inner space of the upper gas circulation chamber; and a header which is provided with a gas outlet on an upper portion thereof; and (iii) a thermal medium jacket which surrounds a side portion and an upper portion of the incinerator housing, wherein thermal medium is introduced from a lower portion of the thermal medium jacket and is discharged through an upper portion of the thermal medium jacket towards the liquid inlet.

3. The waste plastic solid fuel incinerator according to claim 1 or claim 2, wherein the first combustion unit includes a plurality of first combustion chambers arranged in a vertical direction, and wherein the first air supply unit includes a plurality of first air supply tubes for supplying air to the plurality of the first combustion chambers, respectively.

4. The waste plastic solid fuel incinerator according to claim 3, wherein the combustion gas induction unit comprises:

a gas recovery tube an end of which is connected to an end of the lowest first chamber and the other end of which is connected to the downward injection nozzle unit; and a gas fan which is arranged between the end of the gas recovery tube and the other end of the gas recovery tube and is configured to supply the combustion gas generated in the first combustion unit towards the downward injection nozzle unit.

5. The waste plastic solid fuel incinerator according to claim 4, wherein the first combustion chambers comprises:

screw conveyors for continuously transferring the fuel; and pulleys arranged at ends of the screw conveyors, wherein the pulleys of the first combustion chambers are connected via power transmission belts so as to transmit power to the screw conveyors of the first combustion chambers.

6. The waste plastic solid fuel incinerator according to claim 4, wherein the fuel supply unit comprises:

a refuse plastic fuel (RPF) inlet hopper which is arranged outside the incinerator housing and is configured to contain a waste plastic solid fuel; and an RPF inlet screw conveyor which transfers the waste plastic solid fuel contained in the RPF inlet hopper towards the first combustion unit.

7. The waste plastic solid fuel incinerator according to claim 4, further comprising:

an air fan for supplying external air to the first air supply unit and the second air supply unit; and an ash storage tank for storing ash discharged from the lowest first combustion chamber.

* * * * *